United States Patent [19]

Welter

[11] 4,342,889

[45] Aug. 3, 1982

[54] MODULAR VAULT-TYPE LOAD BREAK SWITCH

[75] Inventors: Clarence L. Welter, Valparaiso, Ind.

[73] Assignee: G & W Electric Specialty Company, Blue Island, Ill.

[21] Appl. No.: 26,098

[22] Filed: Apr. 2, 1979

Related U.S. Application Data

[60] Continuation of Ser. No. 797,455, May 16, 1977, Division of Ser. No. 472,969, May 24, 1974.

[51] Int. Cl.[3] ..... H01H 33/08

[52] U.S. Cl. ..... 200/144 R; 200/147 R; 200/252; 200/254; 200/255; 200/260; 335/195

[58] Field of Search ..... 200/147 R, 144 R, 254, 200/255, 260, 252; 335/195

[56] References Cited

U.S. PATENT DOCUMENTS

| | | | |
|---|---|---|---|
| 449,282 | 3/1891 | Clark | 200/252 |
| 3,118,990 | 1/1964 | Jansson | 200/255 |
| 3,356,817 | 12/1967 | Matthews | 200/260 |
| 3,676,629 | 7/1972 | Evans et al. | 200/254 |
| 3,959,616 | 5/1976 | Swanson et al. | 200/254 |
| 4,061,896 | 12/1977 | Clancy et al. | 200/323 |

FOREIGN PATENT DOCUMENTS

| | | | |
|---|---|---|---|
| 1165712 | 3/1964 | Fed. Rep. of Germany | 200/255 |
| 174793 | 2/1922 | United Kingdom | 335/195 |

*Primary Examiner*—Robert S. Macon

*Attorney, Agent, or Firm*—Fitch, Even, Tabin, Flannery & Welsh

[57] ABSTRACT

A modular vault type load break switch wherein the switching assembly is carried within an oil filled vault such that the operation of the switching mechanism is independent of the vault structure. The switching contact mechanism employs a positive actuator which is energized by the operator and contact movement effected by a remotely controlled mechanism independent of operator contact.

2 Claims, 14 Drawing Figures

OU

OL

CU

CL

OU

OL

CU

CL

MODULAR VAULT-TYPE LOAD BREAK SWITCH

This is a continuation of application Ser. No. 797,455, filed May 16, 1977, a divisional of application Ser. No. 472,969, filed on May 24, 1974.

BACKGROUND OF THE INVENTION

This invention relates in general to switching apparatus and, in particular, to a switching apparatus for use in sectionalizing electrical power distribution by underground power cables.

More specifically, this invention relates to a modularized load break switch carried in a below grade vault which is utilized to interrupt load currents within the rating of the device and to minimize equipment failure and possible subsequent human injury upon any occasion of fault current being coupled into the switch.

Switching equipment carried in below grade vaults is utilized to terminate and sectionalize underground electrical power distribution for routing the distribution of electrical energy during various changing power distribution periods or in the event of interruption to normal power distribution channels. Since the electrical power distribution cables are below grade, the switching systems are installed in below grade vaults and, therefore, must be capable of being totally submerged.

In certain prior art systems, the switching apparatus is carried within the below grade vault and the vault pumped dry, or partially dry, when the equipment is operated. In addition, an oil filled tank permits a more compact vault and switching apparatus due to the increased dielectric strength of oil over air, therefore, increasing the arc extinguishing and absorbing characteristics.

Some oil filled switches are manually operated by the direct coupling of an operating handle to the switching assembly. The operating handle on the outside of the tank is directly coupled to the rotating contacts of the switching system inside the tank and, therefore, the velocity and closing of the rotating contact system is entirely dependent upon the skill of the human operator. These direct coupled systems are prone to cause equipment failure and possible subsequent injury to the operator in the event the switch is improperly operated. Such equipment failure and subsequent operator injury are frequently occasioned when an energized switch is accidentally operated into and out of ground position.

Since the load break switches are designed for terminating and sectionalizing electrical power distribution and not for interrupting fault current, the switches are designed to generally handle a symmetrical RMS basis load current of approximately 600 amps or less, and are not designed to interrupt fault currents which may generally run as much as 13,000 to 25,000 amps. In the event an operator closes an energized switch into a ground position, at the instant of contact the operator would feel and hear the flow of fault current and his natural impulse would be to open the switch. The switch would now be required to interrupt fault current which might be twenty to forty times greater than the maximum current load for which the switch is designed. The resulting fault current arc energy which is generated within the vault would generally be sufficient enough to increase the internal tank pressure causing distortion, rupturing and/or an explosion of the switch tank. If interrupting devices such as fuses, circuit breakers, etc. do not clear the fault fast enough switch failure occurs.

In an attempt to overcome equipment failure and possible subsequent operator injury which is occasioned with such type of load break switches, spring mechanisms have been designed to control contact rotation. These spring systems provide sufficient contact velocity and energy for opening and closing the load break switches. They also take the actual movement of the contacts out of the hand of the human operator, and make the closing or opening dependent upon mechanical control. These mechanisms are designed so that rotation of the external operating handle compresses a spring and, upon rotation of the operating handle beyond a predetermined point, the compressed spring energy is transferred to the rotating contact system. As a result, the switch contacts are moved quickly and firmly into their next position, whether it be opened or closed. Due to the speed of the spring energized contact movement on these mechanisms, the external operating handle does not control the switch contact movement. During the opening or closing operation, the compressed spring energy drives the movable contacts faster than the operator can rotate the external operating handle.

With such a properly designed spring loaded mechanism, complete travel of the rotating switch contacts and engagement with the stationary contact is assured regardless of the skill of the operator. Therefore, if an energized feeder is accidentally operated into a grounded system or position, the contacts will rotate to a completely closed position. However, in these systems, if the operator reverses the operation of the external handle immediately after closure of the contacts, for example, as a result of the flow of fault current, the contacts will again be opened. Since the operator's hand would at this point be on the external operating handle when the switch contacts closed into the ground position initiating fault current, the operator's natural instincts would be to immediately rotate the external handle to the open position. In the event, the system fault interrupting devices (fuses, circuit breakers, etc.) had not cleared the fault current before the operator rotated the external handle, the load break switch contacts would be required to interrupt the fault currents which, as previously discussed, are beyond the maximum loading for which the switches are designed.

Another problem heretofore associated with vault type load break switches has been the ease with which the switches may be serviced. Heretofore, the switching contacts, both rotating and stationary, were attached by weldments made to the inside of the tank surfaces. Generally, the stationary switch contacts were attached to the front and back walls of the tank, and the switch components assembled within the tank. The spring mechanisms for opening and closure were attached to the front tank walls, or attached to a shaft and oil seal which in turn were ridgidly secured to the front wall of the tank. The rotating switch contacts had one end attached to the drive mechanism, and the other end of the rotating contact system was generally pivotally secured to a weldment on the rear vault wall.

The load break switches were then filled with oil allowing a sufficient space above the oil for air (or gas) to compensate for oil expansion due to temperature increases. Generally, it is desirable to have the air space as small as possible (usually 15% of tank volume at 25° C.) in order to k-ep minimum vault size while allowing sufficient space such that the pressure which occurs in the sealed tank due to the expansion of the oil is controlled within predetermined limits. A preferred installation procedure is to fill the tank to the proper level, purge the air space with dry nitrogen, and then leave a slight positive pressure of nitrogen over the oil. The air pressure within the sealed tank will then range from negative to positive such that under no load and minimum ambient temperatures the air space pressure is negative and upon maximum load and maximum ambient temperature the air space pressure becomes positive within a controlled amount.

During pressure variations within the tank, the tank walls deflect and the amount of deflection is a function of the tank size, wall thickness, reinforcing, oil volume, air space and other such exemplary factors. Switch designs which utilize the tank wall as an integral part of the switch must limit the maximum allowable pressure within the tank to the point where tank wall deflection will not cause mechanism malfunction, constraint or contact misalignment while the unit is in service.

One attempt to control pressure has been to utilize pressure relief devices to limit the pressure occurring in the space above the oil. However, such devices add to the unit's cost and, if improperly designed or installed, can permit moist air or free water to enter the vault. This, of course, reduces the dielectric qualities of the oil and can lead to switch failure.

The utilization of a larger air space would decrease the pressure somewhat, but results in an overall increase in tank size adding to unnecessary costs. In addition, many installations because of vault size and vault access openings require a predetermined size of tank.

SUMMARY OF THE INVENTION

It is, therefore, an object of this invention to improve vault type load break switches.

Another object of this invention is to increase the protection afforded an operator of a load break switch to prevent equipment failure and subsequent injury to the operator.

A further object of this invention is to improve the operating characteristics of load break switches through various environmental conditions.

Still another object of this invention is to facilitate servicing or replacement of the switching apparatus when necessary.

A still further object of this invention is to make the operational characteristics of the load switch independent of variations of the tank structural changes.

These and other objects are attained in accordance with the present invention wherein there is provided a modular vault type load break switch wherein the switching assembly is carried within an oil filled tank such that the operation of the switching mechanism is independent of the tank structure. The switching contact mechanism employs a positive actuator which is energized by the operator and contact movement effected by a remotely controlled mechanism independent of operator contact.

DESCRIPTION OF THE DRAWINGS

Further objects of the invention, together with additional features contributing thereto and advantages accruing therefrom, will be apparent from the following description of one embodiment of the invention when read in conjuction with the accompanying drawings, wherein.

DESCRIPTION OF A PREFERRED EMBODIMENT

Figure 1:
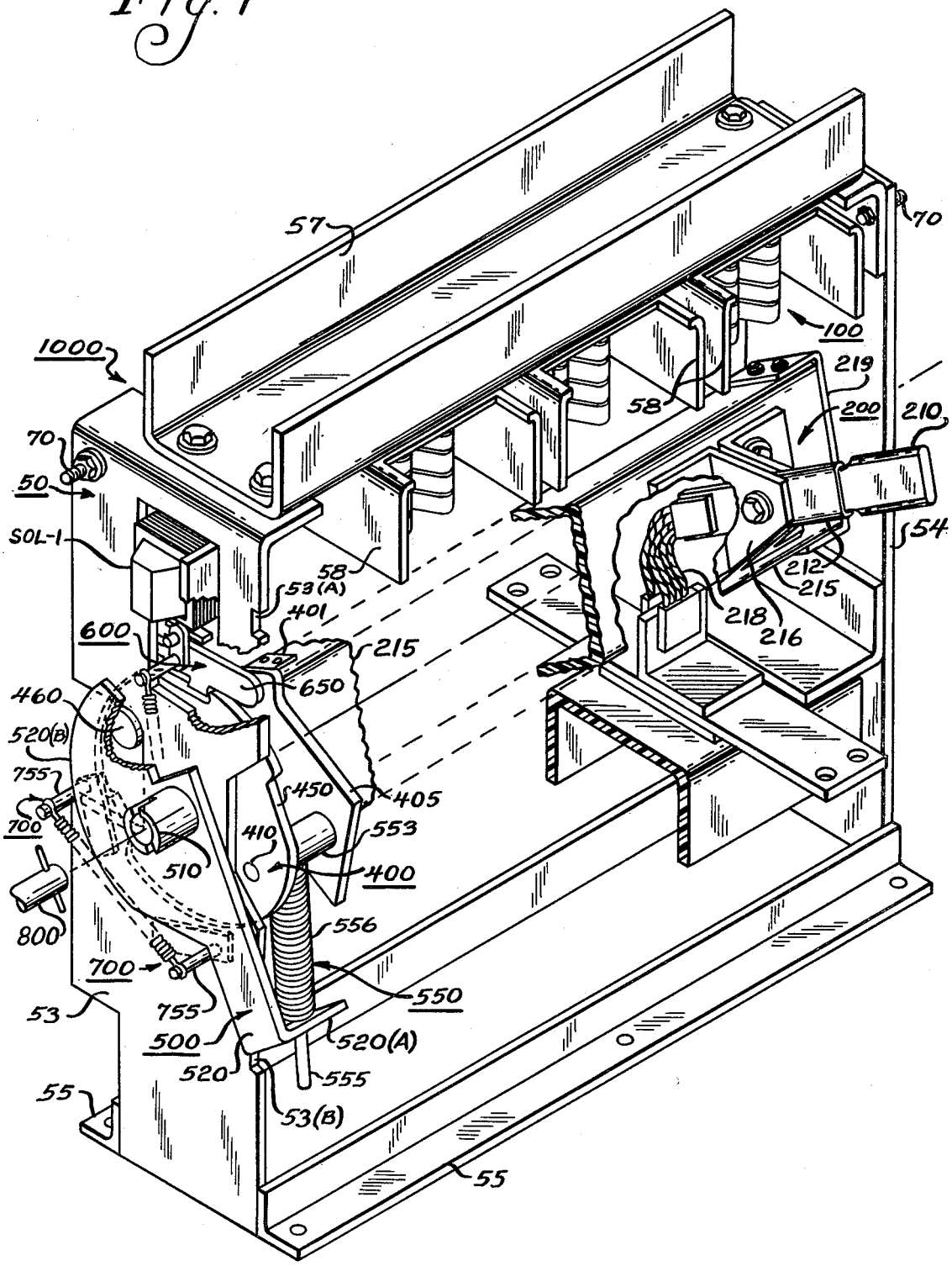
FIG. 1 is a frontal perspective view of a modular vault-type load-break switch with portions broken away to better illustrate the components thereof.

Referring now to FIG. 1, there is shown a modular vault-type load-break switch 1,000 having a stationary contact assembly 100 and a movable contact assembly 200 which are utilized to terminate and sectionalize underground electrical power distribution for routing the distribution of electrical energy during various changing power distribution periods or in the event of interruptions to normal power distribution channels. The stationary and movable contact assemblies are carried by a carriage or frame assembly 50 which is positionable within a below-grade tank, now shown. Opening and closing of the contacts is effected by means of a drive flange assembly 400 and a cocking lever assembly 500.

The carriage or frame assembly 50 includes a pair of parallel-spaced upright front and rear frame members 53 and 54, respectively. The frame members are secured in spaced relationship by a pair of L-shaped channels 55 appropriately secured to the upright frame members as by welding. The L-shaped channels 55 have spaced holes formed therein for securing the switch into a tank. The upper end of the upright frame members 53 and 54 is joined by a stationary contact support 57 formed from an appropriate electrical insulating material, such as Glastic, a tradename for a fiberglass reinforced polyester material having a high (Class B) dielectric strength available from Glastic Corp. The stationary contact support channel 57 functions to support the stationary contact assemblies 100 in a position to be engaged by the movable contact assembly 200 to make or break current flow. Arc barriers 58 formed of a high dielectric material, such as Glastic, are carried by the channel 57 and extend between each of the stationary contacts to function as an arc barrier preventing arcing between the contacts.

Figure 12:
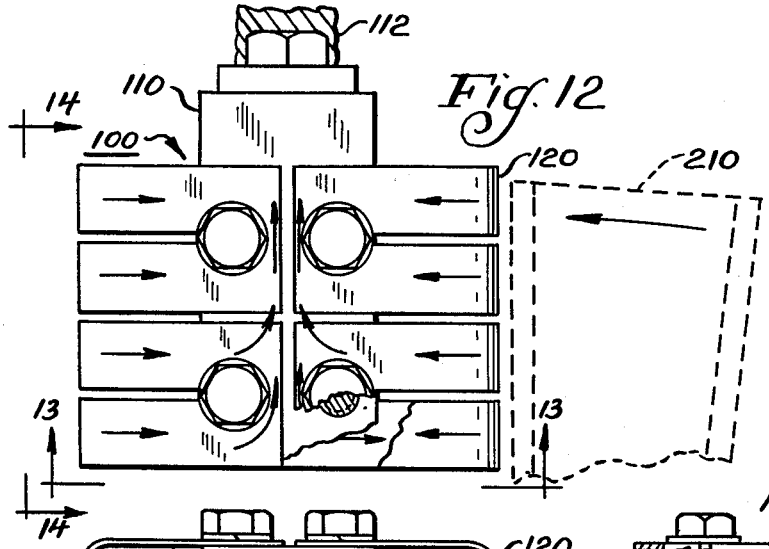
FIG. 12 is an enlarged view of a stationary contact to illustrate the flow of electrical current therethrough for a better understanding of the forces effected thereby.
Figure 13:
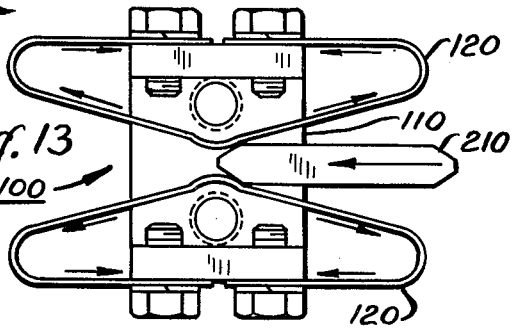
FIG. 13 is a view of the stationary contact of FIG. 12 taken along lines 13—13 with the movable contact shown in a position closing into the stationary contact.
Figure 14:
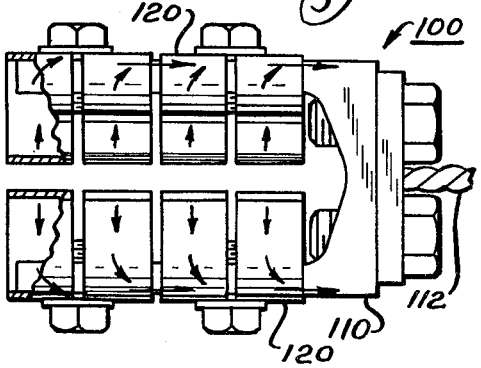
FIG. 14 is a view of the stationary contact shown in FIG. 12 taken along lines 14—14, rotated 90°, and with the movable contact removed.

The stationary contact assembly 100 is best shown in FIGS. 12, 13 and 14, and comprise a bus bar 110 to which an electrical conductor 112 is connected for forming an electric circuit with external electrical leads, not shown. A plurality of spring contacts 120 are secured to the bus bar. The spring contacts 120 are of a resilient conductive material and formed into a shallow triangular cross-sectional configuration as best shown in FIG. 13. The spring contacts are appropriately secured to the bus bar to facilitate replacement as required.

As previously discussed, one of the major problems incurred in the design of load break switches is the formation of arcs during opening or closing of the contacts, and the electrical forces incurred which oppose the making or breaking of the switch contact by creating opposing forces. The flow of electrical current through the spring contacts 120 and bus bar 110 is shown in these figures to better illustrate the unique design of the stationary contact assembly. As best illustrated in FIG. 13, the flow of the electrical current through the contacts upon closing the movable contact 210 into the spring contact 120 creates certain mechanical forces on the contact assembly due to the flow of electrical current.

As shown, the electrical current flow through the opposing portions of the spring contacts 120 closest to the movable contact 210 is in the same direction while the flow of current through the outer portions of the spring contact (base of the triangular shape) is in a direction opposite to that of the "legs", or inner portions of the triangular configuration. Therefore, the two portions of the opposing spring contacts 120 which are closest to the movable contact 210, and have the flow of electrical current in the same direction, will have a force applied thereto tending to press the opposing faces of the opposing spring contacts 120 together thereby pinching the movable contact 210 inbetween the dimple formed at the apex of the spring contact. In addition, due to the triangular configuration of the contacts, each individual contact will have an internal force due to the opposing flow of current between the "base" and the "legs" of the contact which will create a force attempting to expand the contact outwardly into firmer contact with the movable contact 210. Therefore, the unique configuration of the leaf spring contacts minimizes arc formation and the forces which tend to repel the making or breaking of the switch closure.

The movable contact assembly 200, which is utilized to make and break the circuit with the stationary contact assembly 100, comprises upright conductive members or movable contacts 210 having insulative sleeves 212 extending about portions thereof. The movable contacts 210 are supported from a rotating contact support 215 formed from a high dielectric strength material, such as Glastic. Brackets 216, formed from the same material, are secured to the rotating contact support 215 and the rotating or movable contacts 210 to secure the contacts to the rotating support. The end of the movable contacts 210 opposite to that which engages the stationary contacts assemblies 100 is formed to have secured thereto suitable electric leads 218 for coupling to a suitable source of external electrical energy, not shown.

Figure 11:
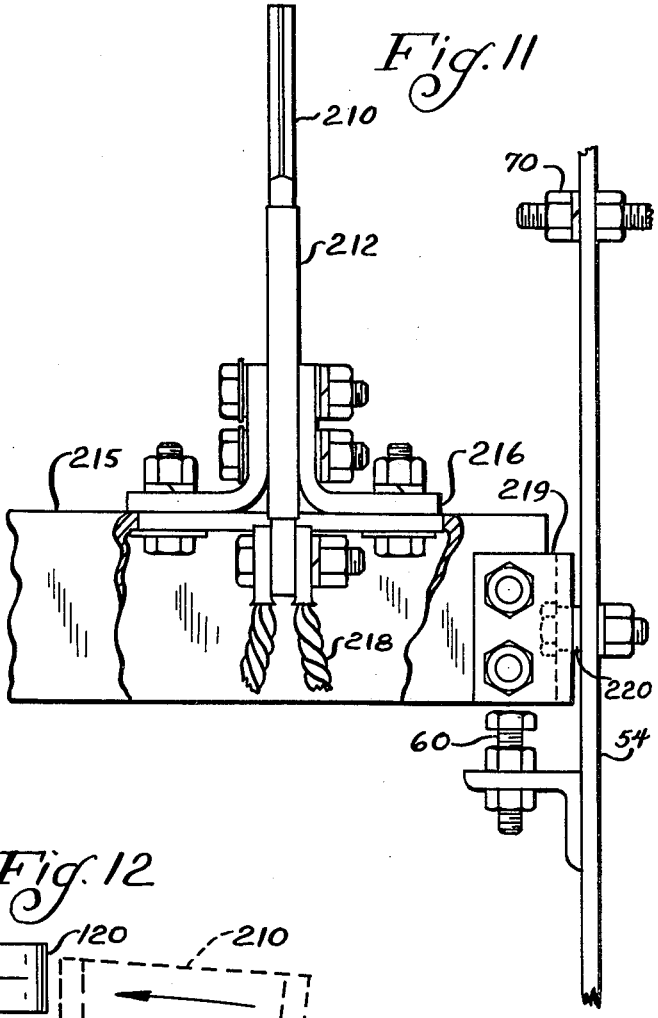
FIG. 11 is a side profile view of a portion of the movable contact assembly to better illustrate portions thereof.

As shown in FIG. 11, the rear end of the rotating contact support 215 is secured to bracket 219 for attachment to the rear frame plate 54 by means of a pivot assembly 220 which allows the rotating contact support 215 to pivot relative to the frame plate, as will be hereinafter described in detail. An adjustable stop member 60 is appropriately secured to the rear frame plate 54, as by welding, and spaced a predetermined distance from engagement with the rotating contact support 215 to limit the movement thereof when the movable assembly is rotated into contact with the stationary contact assembly 100. Adjustable stops 70 are carried by the front and rear frame plates 53 and 54 to position the modular switch within a tank to limit the lateral movement thereof. Adjustable stops 70 are adjusted to be a predetermined space from the walls of the tank to limit the lateral movement of the modular switch assembly.

For reasons previously discussed, one of the most important factors in the operation of a load-break switch is the opening and closing of the contacts. The opening and closing of the movable contacts 210 into the spring contacts 120 of the stationary contact assemblies 100 is effected by the drive flange assembly 400 which is actuated through the cocking lever assembly 500. The front end of the rotating contact support 215 is secured to the drive plate 405 of the drive flange assembly 400 by means of a bracket 401 secured to a portion of the drive flange assembly, as by welding and secured to the rotating contact support 215. The drive plate assembly 400 is pivotally supported in the front frame plate 53 about pivot pin 510 and its rotational movement is controlled by operation of a latch release assembly 600, and its movement in the driven direction limited by means of stop 460 secured to stop plate 450 and any "kick back" is limited by latch cam assembly 700. The power to rotate the drive flange assembly 400 is provided by means of the cocking lever assembly 500 whose operation will be described hereinafter in detail.

For a better understanding of the rotational movement of the drive flange assembly 400 to effect the opening and closing of the contacts 210 into the leaf spring contacts 120 of the stationary contact assembly, reference is made to FIGS. 6, 7, 8, and 9. These figures illustrate the function of the stop plate 450, the latch release 650 and the latch cam assembly 700.

Figure 6:
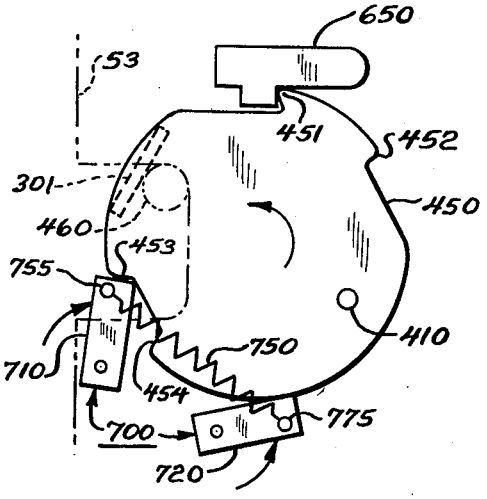
FIG. 6 is a frontal planar view of the switch assembly with portions removed to better illustrate the drive flange assembly in relationship to the latching cams, the latch release and the stop pin illustrating the switch in an open and unloaded position.

In the position shown in FIG. 6, the switch contacts are in an open position and there is no mechanical force tending to close the contact. This position is referred to as an open and unloaded position. The stop plate 450, which is formed with a first cam stop 451 is engaged by the latch release 650 preventing movement in a counterclockwise (CCW) direction. A stop 460, which is secured to the stop plate 450 as by welding, is engaged with the upper end of an undercut portion of the frame plate 53. The latch cam assembly 700, which is pivotally supported by frame plate 53, is positioned with one latch 710 engaging a notch 453 of the stop plate latching the plate to prevent rotational movement in a CCW direction. The other latch cam 720 has been cammed upon the outer surface of the stop plate. The latch cams 710 and 720 are pivotally secured to the frame plate 53 and rotatably biased towards each other in the directions indicated by the arrow by means of a spring 750 appropriately secured to pins 755 extending outwardly from each latch cam. The latch cam 710 engaging the notch 453 limits the counter-clockwise position of the stop plate 450, while the stop 460 secured to the stop plate engages the undercut portion of frame plate 53 limiting the clockwise movement of the stop plate. In this position, the latch release 650 may be moved out of engagement with the cam 451 without effecting movement of the drive plate assembly.

Figure 7:
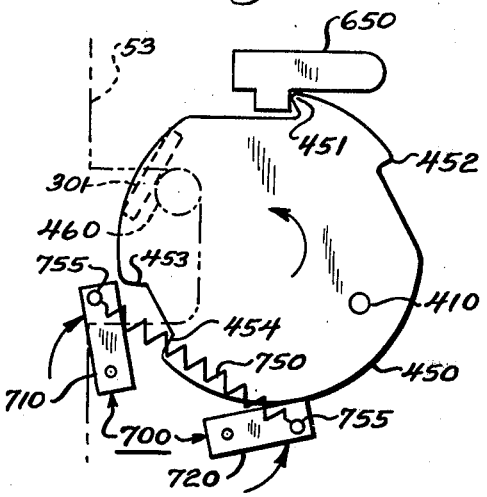
FIG. 7 is a view similar to FIG. 6 with the switch in an open and loaded to closed position.

Referring to FIG. 7, the stop plate 450 and the latch cam assembly 700 are shown in the position wherein the switch contacts are open and the mechanism has been loaded to apply a mechanical force for closing the rotating contacts 210 into the stationary contact assemblies 100. As previously described, the cam stop 451 of the stop plate is engaged with the latch release 650, and the stop 460 is engaged with the upper portion of the undercut of the frame plate 53. The latch 720 is biased into contact with the outer surface of the stop plate. However, the latch 710 has been moved out of engagement with notch 453. Therefore, upon movement of the latch release 650 out of engagement with the cam portion 451, the stop plate 450 will be free to rotate in a counter-clockwise direction. Rotation of the stop plate in a counter-clockwise direction will close the movable contacts 210 into engagement with the stationary contact assemblies 100.

Figure 8:
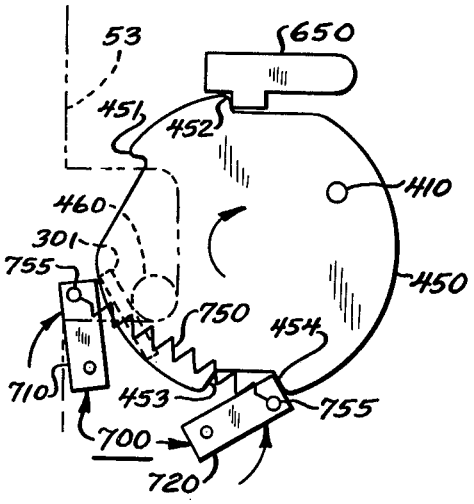
FIG. 8 is a view similar to FIG. 6 with the switch in a closed and unloaded position.

Referring now to FIG. 8, the stop plate and latch cam assembly 700 are shown after the latch release 650 has been removed from engagement with the cam stop 451 driving the rotating or movable contacts 210 to close into the stationary contact assemblies 100. The latch release 650 is engaged with the cam stop 452 of the stop plate, and the stop member 460 has engaged the bottom portion of the undercut of the frame plate thereby limiting the clockwise rotation of the stop plate 450. The latch 720, which was biased by means of the spring 750 into engagement with the outer surface of the stop plate, has engaged notch 454 thereof thereby limiting the clockwise rotation of the stop plate 450. The latch 710 is biased into contact with the stop plate 450 and is carried against the outer surface thereof. In this position, the latch release 650 may be moved out of engagement with the cam 452 without effecting any movement of the switch contact assembly.

Figure 9:
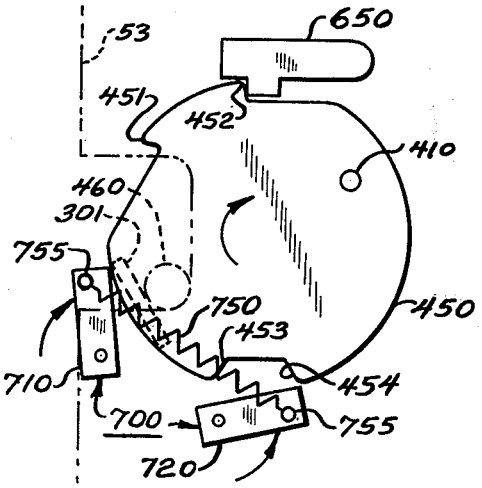
FIG. 9 is a view similar to FIG. 6 with the switch in a closed and loaded to open position.
Figure 10:
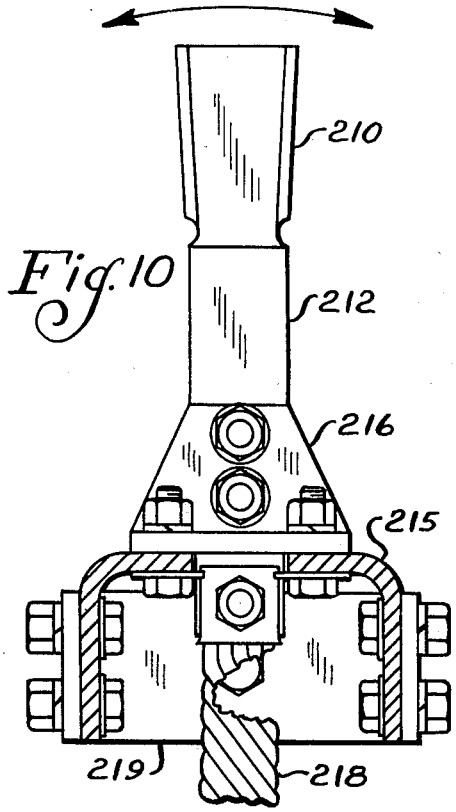
FIG. 10 is a cross-sectional view of the movable contact assembly to better illustrate the components thereof.

Referring now to FIG. 9, the stop plate 450 and latch cam assembly 700 are shown in the position wherein the switch contacts are closed and the drive assembly has a mechanical force coupled thereto for opening the switch contacts. In this position the stop 460 is still engaging the lower undercut portion of the frame plate 53, the latch 710 is biased into conta-t with the outer surface of the stop plate 450. The latch release 650 is engaging the cam stop 452. The latch 720 has been cammed outwardly from engaging the notch 454 such that upon movement of the latch release 650 out from engagement with the cam stop 452 the stop plate 450 will be rotatably driven in a clockwise direction.

The mechanical force applied to the drive flange assembly for opening and closing the switch contacts is provided by means of the cocking lever assembly 500 which is operatively connected to the drive flange assembly 400 by means of a pin 410 extending between the stop plate 450 and the drive plate 405. The drive flange assembly is operatively driven through the pin 410 which is connected to the cocking lever assembly 500 through a spring assembly 550.

The operation of the cocking lever assembly 500, which is utilized to provide the rotational force to open and close the switch contacts, is best described with reference to FIGS. 2, 3, 4, and 5.

FIGS. 2, 3, 4, and 5 illustrate the vault switch in an open-unloaded, open-loaded to close, close-unloaded, and closed-loaded to open positions, respectively.

The cocking lever assembly 500, which is utilized to provide the rotational drive force to the drive flange assembly for opening and closing the switch contacts, is pivotally supported relative to the front frame member 53 by pivot pin means 510 having a notch therein which is engageable by the drive pin of a crank or lever arm 800 (FIG. 1). The lever arm 800 is utilized to turn the cocking lever assembly to compress spring 556 effecting the biasing action of the spring assembly 550. The cocking lever assembly 500 includes a cocking arm 520 which is secured to the pivot pin 510 to be turned by means of the crank or lever arm 800. The cocking arm 520 has an extended portion 520(A), turned at an angle to the other portion of the cocking arm, which is formed with an aperture therein through which passes the spring guide rod 555 of the spring assembly 550. The spring guide rod 555 functions to support the compression spring 556 which extends between the portion 520(A) at one end and a sleeve-bearing 558 which engages the other end of the spring and to which the spring guide rod 555 is secured. The sleevebearing 558 is supported about the pin 410 and provides the link for effecting the rotational driving force of the spring 556 against the drive flange assembly 400.

Figure 2:
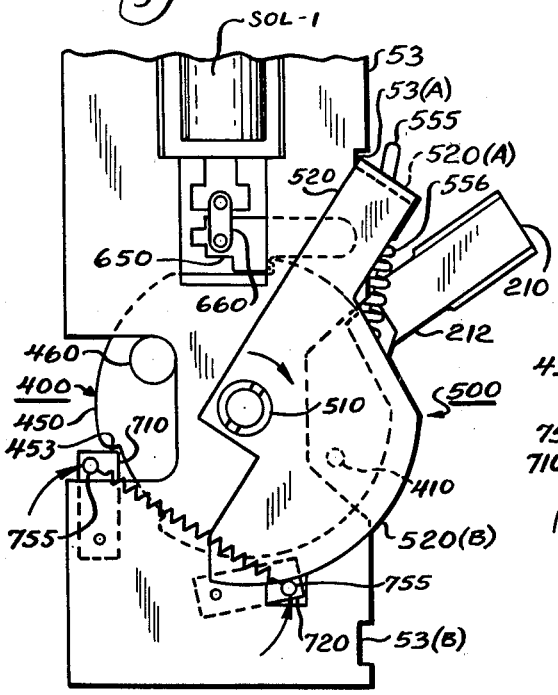
FIG. 2 is a frontal planar view of the switch assembly in an open and unloaded position.
Figure 3:
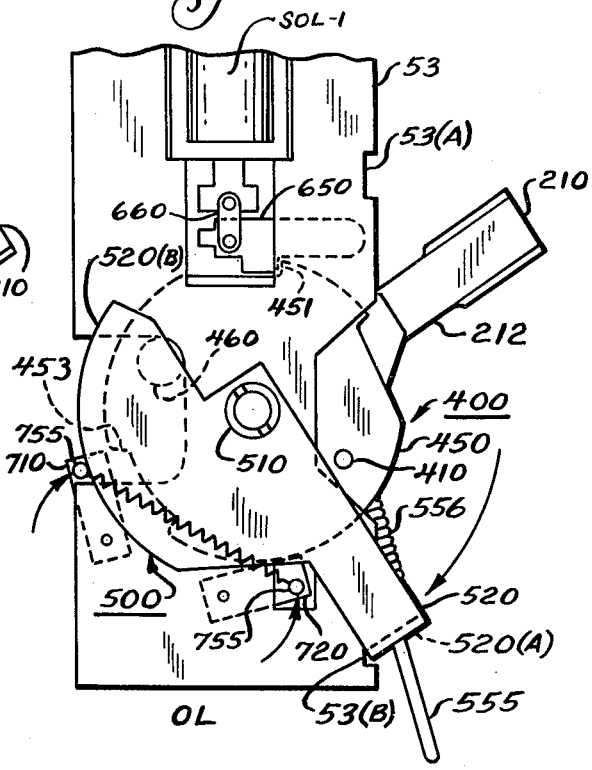
FIG. 3 is a frontal planar view of the switch assembly in an open and loaded to close position.

When the switch is in the open-unloaded position shown in FIG. 2, the cocking arm 520 is in its uppermost position engaging notch 53(A) formed in the frame plate 53. The notches 53(A) and 53(B) are formed in the frame plate to allow the cocking lever 520 to be moved past dead center and into these notches when the spring is loaded for driving the movable contacts 210 into or out from engagement with the stationary contact assemblies 100. With the cocking lever in its uppermost position engagement notch 53(A) the spring 556 is in its relaxed position and pin 755 of latch cam 720 is engaging the cam portion 520(B) of the cocking lever such that upon clockwise movement of the cocking lever, the latch cam 720 will be moved in accordance with the cam surface. To prepare the switch assembly for closing the movable contacts 210 into the stationary contact assemblies, the lever 800 is engaged with the pivot 510 and the cocking arm rotated in a clockwise direction.

After the cocking arm has been rotated in a clockwise direction to its lowermost position (FIG. 3), the cocking arm will engage notch 53(B) of the frame plate. During rotation of the cocking arm, the spring 556 is compressed between the bearing surface 558, which surrounds the pivot pin 410, and the end 520(A) of the cocking lever. In this manner, the force of the compressed spring 556 is applied against the pivot pin 410 to rotate the drive flange assembly 400 in a counterclockwise direction to engage the movable contacts 210 into the stationary contact assemblies. However, as previously described, with reference to FIGS. 6, 7, 8, and 9, the release cam 650 engaging the stop 451 of the stop plate 450 prevents rotation of the drive flange assembly 400. Rotation of the cocking arm causes the cam surface 520(B) to engage pin 755 of the latch cam 710 camming the latch out from engagement with notch or recess 453 as previously described. The switch contacts are now open, but in a loaded position for closing the contacts. Upon release of the latch 650 from engagement with the cam stop 451, the power compressed in the spring 556 will be released against the pivot pin 410 rotatably driving the drive flange assembly 400 in a counter-clockwise direction closing the contacts. Latch cam 720 will engage notch 454 of the stop plate and the stop 460 will engage the lowermost portion of the undercut in frame 53.

Figure 4:
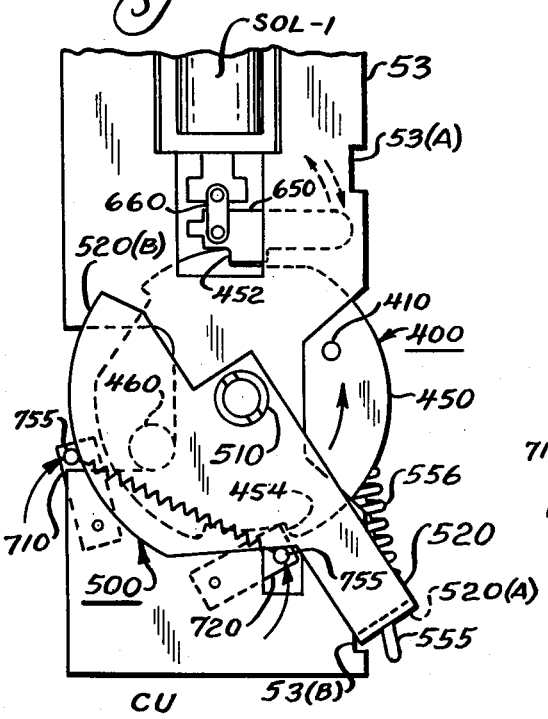
FIG. 4 is a frontal planar view of the switch assembly in a closed and unloaded position.
Figure 5:
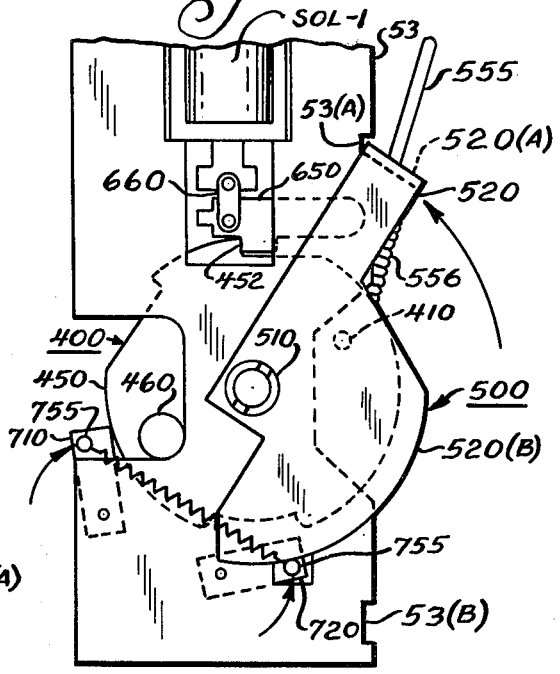
FIG. 5 is a frontal planar view of the switch assembly in a closed and loaded to open position.

When it is desired to open the contacts, the switch assembly will be in the configuration as shown in FIG. 4. The cocking arm 520 is at its lowermost position engaging the notch 53(B) of the frame plate 53. The latch cam 710 is cammed outwardly along the cam surface 520(B) of the cocking arm and the latch cam 720 is engaging notch 454 of the stop plate. Latch release 650 is engaging cam stop 452 of the stop plate. In this position the switch contacts are closed into each other and the spring 556 is in its relaxed or unbiased state.

When it is desired to open the contacts, the lever 800 is engaged with the pivot 510 and the cocking arm 520 rotated in a counter-clockwise direction compressing the spring between the bearing surface 558 and the end 520(A) of the cocking arm. Rotation of the cocking arm cams the latch cam 720 out of engagement with notch 454, and allows latch cam 710 to contact the outer surface of the stop plate 450. Upon release of the latch 650 from engagement with the cam stop 452 the compressed power of the spring 556 will drive the drive flange assembly 400 in a clockwise direction opening the contacts and allowing latch release cam 710 to engage notch 453 of the stop plate. Stop 460 will engage the upper part of the undercut portion of the front frame plate 53.

The latch release 650 is moved out of engagement with the cam stops 451 and 452 of the stop plate by means of an electric solenoid SOL-1 appropriately secured to the latch release through linkage 660 attached to the plunger of the solenoid. While the solenoid is illustrated as a preferred embodiment, various other alternative actuators may be utilized to pivot the latch release out of engagement with the stop plate.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. Switch contact means for electrical power distribution load break switches for switching a plurality of phases, comprising:

a plurality of pairs of resilient spring contacts for coupling with each of the phases, a plurality of blade contacts for electric engagement with each of said pairs of resilient spring contacts, each of said pairs of resilient spring contacts being mounted on a bifurcated electrically conductive support means with the resilient spring contacts in confronting relation with each other, one of said blade contacts being received between each of said pairs of resilient spring contacts, each of said resilient spring contacts being formed into a closed loop so that upon entry of a blade contact between a pair of resilient spring contacts current flow through the closed loop produces a force biasing said resilient spring contacts toward each other and against said blade contact, said pairs of resilient spring contacts being spaced apart from each other, and a dielectric barrier disposed between said pairs of resilient spring contacts to suppress arcing therebetween.

2. The apparatus of claim 1 wherein each of said resilient spring contacts includes a single projecting apex for engagement with that blade contact.

* * * * *